US006837160B2

(12) United States Patent
Leppanen et al.

(10) Patent No.: US 6,837,160 B2
(45) Date of Patent: Jan. 4, 2005

(54) METHOD AND APPARATUS FOR CLAMPING A PRINTING MEDIA

(75) Inventors: Seppo I. Leppanen, North Vancouver (CA); Roland W. Montague, Sidney (CA); Dror Toledo, Modi'in (IL)

(73) Assignee: Creo, Inc., Burnaby (CA)

( * ) Notice: Subject to any disclaimer, the term of this patent is extended or adjusted under 35 U.S.C. 154(b) by 0 days.

(21) Appl. No.: 10/603,736

(22) Filed: Jun. 26, 2003

(65) Prior Publication Data

US 2004/0046863 A1 Mar. 11, 2004

Related U.S. Application Data

(60) Provisional application No. 60/391,440, filed on Jun. 26, 2002.

(51) Int. Cl.[7] ..... B41F 1/28

(52) U.S. Cl. ..... 101/415.1; 101/389.1; 400/618

(58) Field of Search ..... 101/389.1, 415.1, 101/477; 400/618

(56) References Cited

U.S. PATENT DOCUMENTS

| | | | | | |
|---|---|---|---|---|---|
| 3,550,745 | A | * | 12/1970 | Tessitore et al. | 400/618 |
| 3,802,546 | A | * | 4/1974 | Helms | 400/618 |
| 4,167,346 | A | * | 9/1979 | Holland-Letz | 400/618 |
| 4,528,906 | A | * | 7/1985 | Hasegawa | 101/127.1 |
| 5,503,075 | A | * | 4/1996 | Matsuo et al. | 101/477 |
| 5,685,226 | A | | 11/1997 | Fuller | |
| 5,699,740 | A | | 12/1997 | Gelbart | |
| 5,947,028 | A | | 9/1999 | Montgomery et al. | |
| 6,003,442 | A | | 12/1999 | Solomon et al. | |
| 6,130,702 | A | | 10/2000 | Ganton | |
| 6,189,452 | B1 | | 2/2001 | Halup et al. | |
| 6,260,482 | B1 | | 7/2001 | Halup et al. | |
| 6,267,054 | B1 | | 7/2001 | Lopes | |
| 6,295,929 | B1 | | 10/2001 | Tice et al. | |
| 6,334,393 | B1 | * | 1/2002 | Asai et al. | 101/477 |
| 6,382,096 | B2 | * | 5/2002 | Watanabe | 101/128.1 |
| 6,457,410 | B1 | * | 10/2002 | Zerillo | 101/389.1 |
| 6,505,551 | B1 | * | 1/2003 | Kawabe et al. | 101/116 |
| 6,729,234 | B2 | * | 5/2004 | Shih | 101/389.1 |
| 6,729,235 | B2 | * | 5/2004 | Kerr | 101/415.1 |

FOREIGN PATENT DOCUMENTS

| | | |
|---|---|---|
| JP | 01148451 | 9/1989 |

* cited by examiner

*Primary Examiner*—Eugene H. Eickholt
(74) *Attorney, Agent, or Firm*—Kristofer E. Elbing

(57) ABSTRACT

A magnetic clamp for firmly clamping the edge of an imaging media on an imaging bed has one or more magnetic assemblies located in a clamp frame. The magnetic assemblies include magnets which may be permanent magnets, the magnets are prevented from contacting the imaging bed surface by pole pieces. The pole pieces contact the surface of an imaging bed thus channelling the magnetic flux generated by the magnets through the surface to provide a clamping force. In one embodiment, the magnetic assemblies are slidable in a frame to allow clamping of different thickness media.

22 Claims, 9 Drawing Sheets

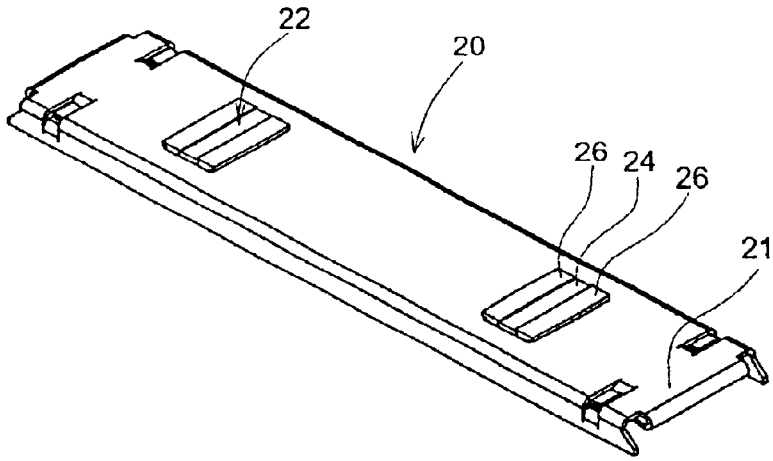
FIG. 1-A
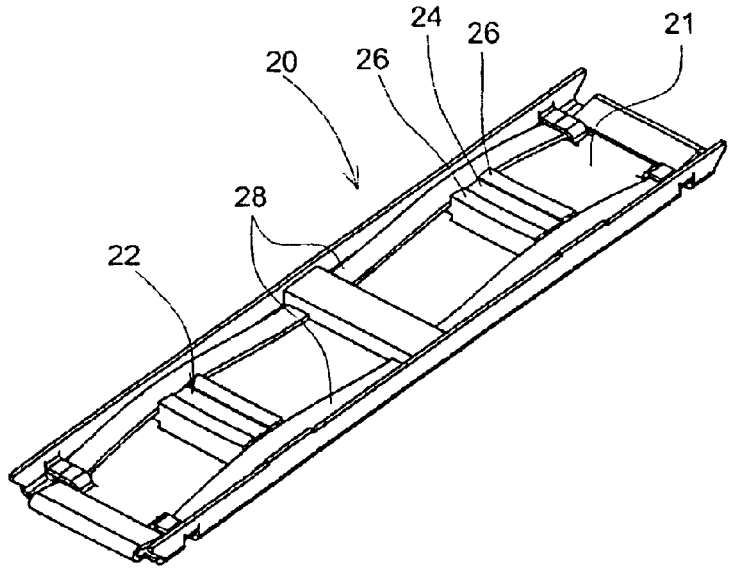
FIG. 1-B

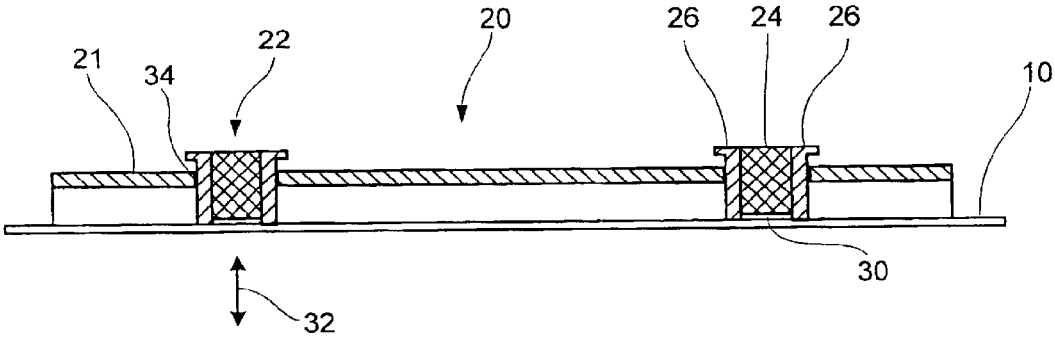
FIG. 1-C
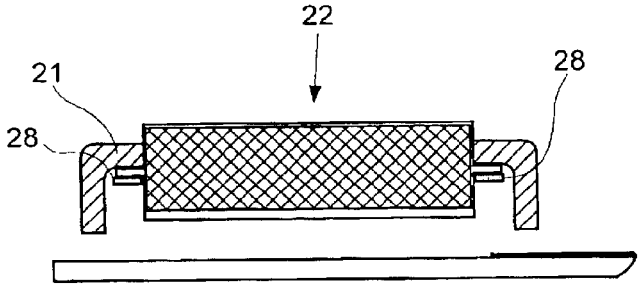
FIG. 2-A
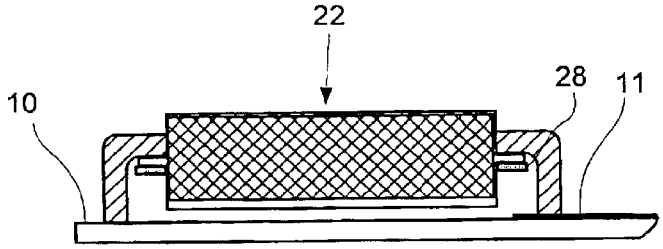
FIG. 2-B
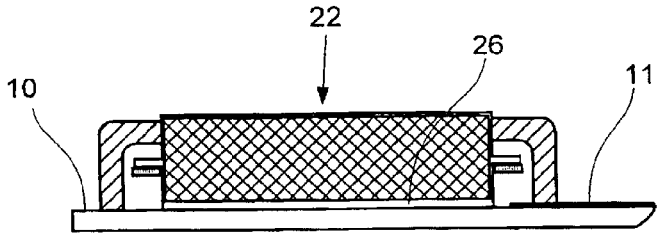
FIG. 2-C

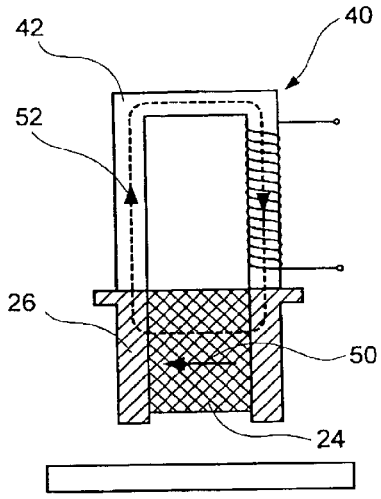
FIG. 4-A
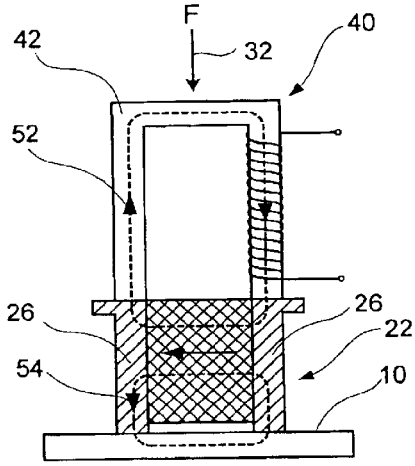
FIG. 4-B
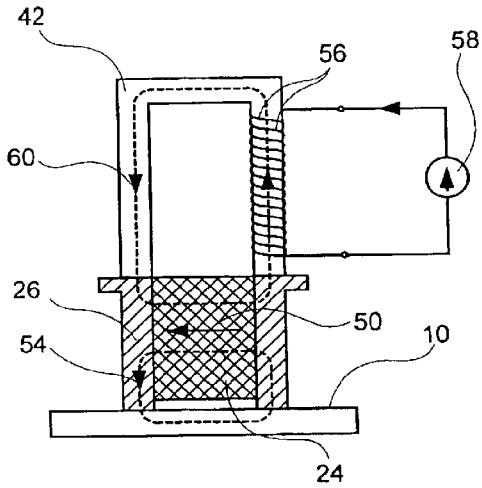
FIG. 4-C
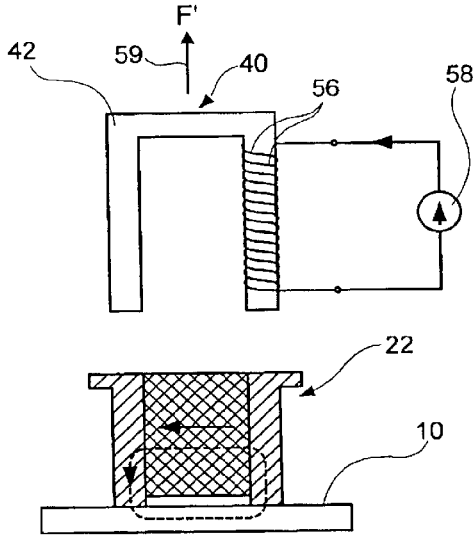
FIG. 4-D

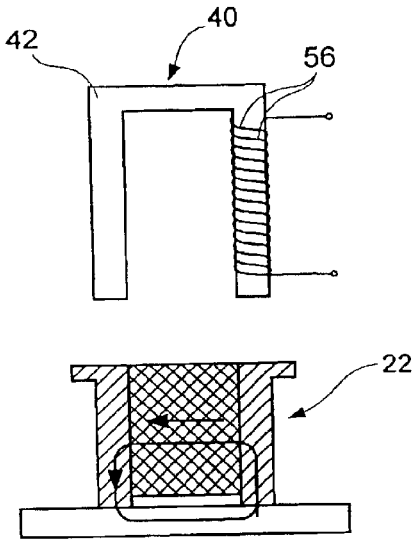
FIG. 5-A
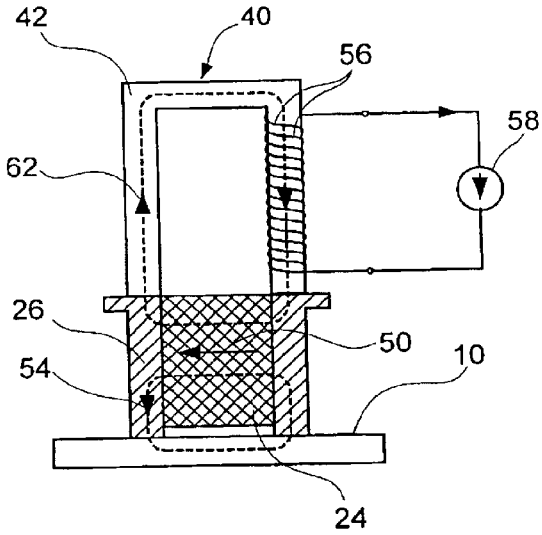
FIG. 5-B
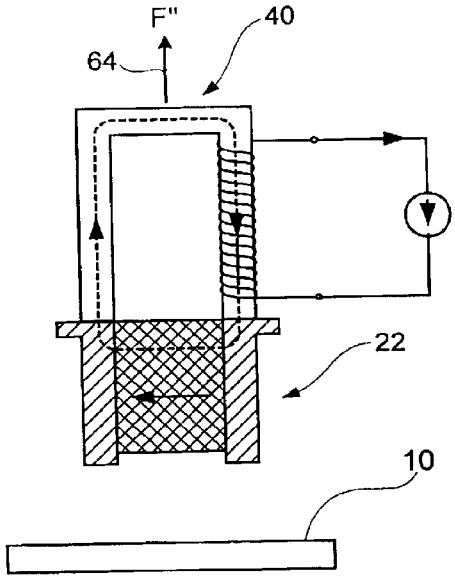
FIG. 5-C

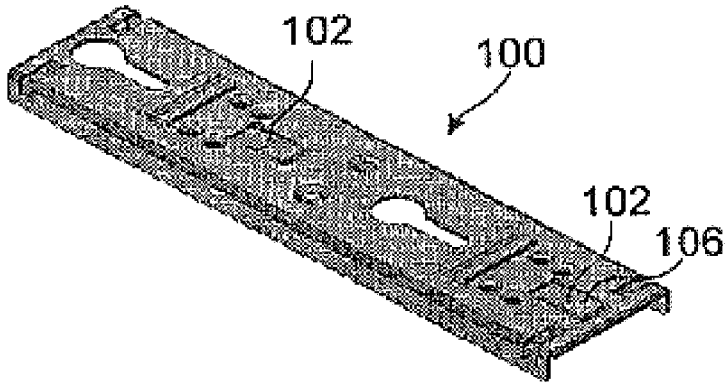
FIG. 8-A
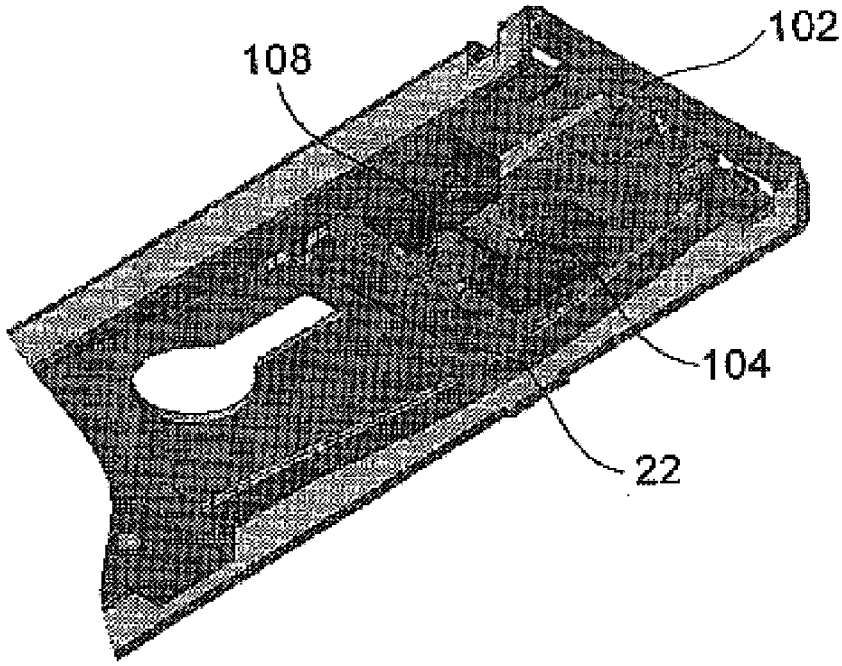
FIG. 8-B

METHOD AND APPARATUS FOR CLAMPING A PRINTING MEDIA

REFERENCE TO RELATED APPLICATION

This application claims the benefit of the filing date of co-pending application No. 60/391,440 filed on Jun. 26, 2002 and entitled METHOD AND APPARATUS FOR CLAMPING A PRINTING MEDIA, which is hereby incorporated herein by reference.

TECHNICAL FIELD

This invention relates to imaging of media and more particularly to apparatus for holding media sheets on imaging beds.

BACKGROUND

In the printing pre-press industry, it is often necessary to retain a plate or sheet of media on a surface so that it can be imaged. Typically, an imaging source is scanned relative to the surface of the media by either moving the imaging source or the media or a combination thereof. For example, many computer-to-plate or computer-to-press systems image a lithographic printing plate that is held onto the outside surface of a rotating drum. Systems are also available for imaging a plate held on the internal surface of a cylinder or on a flat platen.

Commonly assigned U.S. Pat. No. 6,130,702 to Ganton shows a combination of a mechanical reference edge and clamp for retaining the leading edge of a plate and magnetic clamps for retaining the trailing edge of the plate. The leading edge clamp is usually fixed in location while the magnetic clamp can be placed in a variety of locations to suit a range of plate sizes. The drum is made of a ferromagnetic material such as cast iron or has ferromagnetic inserts.

There remains a need for better magnetic clamps for holding media to imaging beds. There is a particular need for such clamps that provide increased holding forces and can accommodate media of different thicknesses.

SUMMARY OF THE INVENTION

This invention provides magnetic clamping systems for clamping media to imaging beds. The systems include magnetic assemblies which are moveable relative to a clamp frame and have a biasing mechanism which biases the clamp frame toward the imaging bed.

In a first aspect of this invention, a magnetic clamp for securing a media to an imaging bed comprises a clamp frame adapted to engage the media and at least one magnet located in the clamp frame. The magnet is moveable between a first position wherein the magnet is spaced apart from said imaging bed and a second position wherein the magnet engages the imaging bed. The clamp has a spring for resiliently biasing the magnet toward the first position.

In another aspect of the invention, the magnetic clamp is provided with means for temporarily reducing the attractive force between the magnetic assembly and the imaging bed to facilitate a clamping or retracting operation.

Further aspects of the invention and features of specific embodiments of the invention are set out below.

BRIEF DESCRIPTION OF THE DRAWINGS

In drawings which illustrate example embodiments of the invention:

FIG. 1-A is an isometric view of the top surface of a clamp according to an embodiment of the present invention;

FIG. 1-B is an isometric view of the bottom surface of the clamp depicted in FIG. 2-A;

FIG. 1-C shows a longitudinal sectional view of the clamp depicted in FIG. 1-A;

FIG. 2-A to FIG. 2-C depict an end view a clamping operation of a preferred embodiment of the clamp;

FIG. 4-A to FIG. 4-D depict a series of steps performed in clamping a media on a ferromagnetic surface;

FIG. 5-A to FIG. 5-C depict a series of steps performed in un-clamping a media from a ferromagnetic surface;

FIGS. 8-A and 8-B are isometric views of another alternative embodiment of the clamp;

DESCRIPTION

Figure 3:
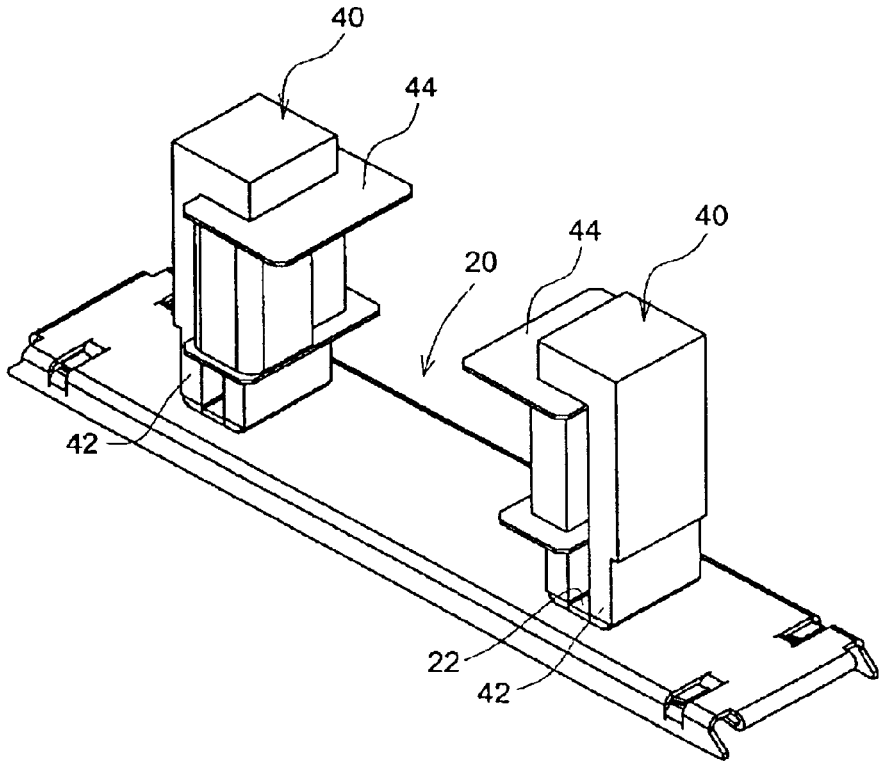
FIG. 3 is an isometric view of a clamp with a retracting device shown in place on each magnet.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

In an embodiment of the invention shown in FIGS. 1-A to 2-C, a clamp 20 comprises a pair of magnet assemblies 22 mounted on a frame 21. Frame 21 is U-shaped in cross section. As shown in FIGS. 2-A to 2-C, frame 21 has an edge portion which can press against a media sheet 11 and therefore constitutes a media-engaging portion of frame 21. Each magnet assembly 22 has a central permanent magnet 24 with pole pieces 26 located on either side of permanent magnet 24.

A longitudinal section through clamp 20 is shown in FIG. 1-C. Clamp 20 is located on ferromagnetic surface 10 which may be part of an imaging bed. The imaging bed may comprise the surface of a drum or a flat surface, for example. The imaging bed may be made from a ferromagnetic material, such as cast iron, or may have ferromagnetic inserts in the appropriate areas. Pole pieces 26 are arranged to contact ferromagnetic surface 10. Permanent magnet 24 is recessed relative to pole pieces 26 so that permanent magnet 24 is spaced apart from surface 10 of the imaging bed by a gap 30. Advantageously permanent magnet 24 has pole pieces 26 permanently attached or bonded to it to form a magnet assembly 22 but this is not mandatory. The term "magnet assembly" or "magnet" is used herein to refer to an assembly including a permanent magnet disposed to provide a magnetic clamping force according to the invention. A magnet assembly or magnet may include one or more pole pieces of ferromagnetic material.

Permanent magnets 24 are preferably rare earth compounds having high Energy Product for their size. Energy Product indicates the energy that a magnetic material can supply to an external magnetic circuit when operating at any point on its demagnetization curve. Energy products is measured in megagauss-oersteds (MGOe). While ceramic or ALNICO magnets may be used, they tend to have a poor energy product to weight ratio. The additional weight of such permanent magnets will at least partially defeat the additional holding forces gained at higher rotational speeds.

In the embodiment of FIGS. 1-A and 1-B, magnets 22 are free to slide in slots 34 provided in frame 21 in the direction of arrow 32 to allow a range of different thickness media to be clamped while maintaining pole pieces 26 in contact with surface 10. FIG. 1-B shows the underside of clamp 20. Magnets 22 are retained by a number of flat springs 28. Flat springs 28 provide a spring suspension for magnets 22 allowing them to slide in frame 21 under the retaining force of springs 28, thus accommodating plates 11 having different thicknesses.

The function of springs 28 is explained with reference to FIGS. 2-A to 2-C. In FIG. 2-A, a clamp 20 is shown in a retracted position. Springs 28 urge magnet 22 away from surface 10 and toward clamp frame 21. In FIG. 2-B, clamp 20 is placed on ferromagnetic surface 10 with edge 21A of frame 21 holding an edge of media 11 to imaging bed 10. In this position, an attractive force is established between magnet 22 and ferromagnetic surface 10. In FIG. 2-B, magnets 22 are still in the retracted position. In the retracted position, pole pieces 26 are spaced apart from surface 10 by a distance D, and the attractive force between magnets 22 and surface 10 is relatively weak. Springs 28 have stiffness sufficient to overcome this relatively weak attractive force. Thus, springs 28 hold magnets 22 retracted away from surface 10 while frame 21 of clamp 20 is brought into contact with surface 10 and arranged to hold media 11.

In FIG. 2-C, magnets 22 have been brought into contact with surface 10. Magnets 22 are strong enough that, when they are in contact with (or in very close proximity to) surface 10 they can hold themselves to surface 10 against the bias force exerted by springs 28. Magnets 22 may be moved between the configuration of FIG. 2-B and the configuration of FIG. 2-C by driving them onto surface 10 using a suitable actuator (not shown). When pole pieces 26 are in contact with ferromagnetic surface 10 they form part of a magnetic circuit. A substantial portion of the flux generated by permanent magnet 24 is channeled into this circuit, thus providing a high clamping force. Because magnet assemblies 22 are able to move relative to frame 21, different thickness media 11 can be clamped while maintaining contact between pole pieces 26 and ferro-magnetic surface 10. Once a magnet assembly 22 is in contact with ferromagnetic surface 10, the attractive forces are high.

While clamp 20 is secured to surface 10 by magnets 22, springs 28 cause edge 21A of frame 21 to clamp media 11 to surface 10. The clamping force applied to the media 11 is provided by pre-loaded springs 28. Advantageously, since the pole pieces of magnets 22 remain in contact with surface 10, the anchoring force between magnets 22 and surface 10 is not affected by the thickness of media 11. In prior art magnetic clamping systems in which media 11 is between a magnet and a surface the force of attraction between the media and the surface can decrease with the thickness of the media being clamped.

In FIG. 3, clamp 20 is shown with an electromagnetic retracting device 40 installed on each magnet assembly 22. Retracting devices 40 each have a core 42 of ferromagnetic material in an inverted U-shape. A coil 56 is wound around core 42. Coil 56 can be wound around one leg of core 42, as shown in FIGS. 4-A to 4-D. The operation of retracting device 40 to place clamp 20 is explained with reference to FIGS. 4-A to 4-D. In FIG. 4-A, permanent magnet 24 is polarized in the direction of arrow 50 thus establishing a magnetic flux through the core 42 of retracting device 40 in the direction indicated by arrow 52. A large portion of the magnetic flux is channelled through core 42 providing a strong attachment force to pole pieces 26.

In FIG. 4-B, pole pieces 26 are driven into contact with ferromagnetic surface 10 by an actuation force F, shown by arrow 32, applied to the retracting device. Under these conditions, the magnetic flux divides between retracting device core 42, in the direction indicated by arrow 52, and the magnetic circuit formed through ferromagnetic surface 10 indicated by arrow 54. The attractive forces between magnet assembly 22 and the retracting device 40 on one hand, and magnet assembly 22 and ferromagnetic surface 10, on the other hand, are of similar magnitude so that magnet assemblies 22 remain on the retracting device while being brought into contact with ferromagnetic surface 10. While it is not essential that these forces be exactly the same, they can be balanced to a sufficient extent by choosing the materials and dimensions of the retracting device to channel enough magnetic flux through core 42.

Referring now to FIG. 4-C an electrical current is now applied to coil 56 by current source 58. The electrical current establishes a magnetic flux in a direction indicated by arrow 60, in opposition to the flux generated by permanent magnet 24, thus weakening the attractive force between the magnet and retracting device core 42. At the same time, the magnetic flux 54 is strengthened as the magnetic flux from permanent magnet 24, in the direction of arrow 50, is mostly channeled into the magnetic circuit defined by pole pieces 26 and ferromagnetic surface 10.

Finally, in FIG. 4-D retracting device 40 is removed from magnet assembly 22 by applying an actuation force F' in the direction shown by arrow 59. Retraction is easily accomplished under conditions of reduced force as established by the current flow through coil 56, thus leaving magnet 22 firmly located on the imaging bed 10.

Advantageously the clamping scheme described allows clamping with high force, irrespective of media thickness while not subjecting clamp frame 21 to forces that may damage it.

Clamp 20 may be removed from surface 10 by essentially reversing the above-described process of placing it. FIGS. 5-A to 5-C illustrate a method for removing clamp 20 from surface 10. In FIG. 5-A core 42 of retracting device 40 is spaced apart from magnet assembly 22 with no current applied to coil 56. In FIG. 5-B, retracting device 40 is brought into contact with pole pieces 26. A current is applied by current source 58 to coil 56, this time in the reverse direction thus establishing a magnetic flux 62 that co-operates with the flux through core 42 due to permanent magnet 24. This ensures the force of attraction between magnet assembly 22 and retracting device 40 is stronger than the force between magnet assembly 22 and ferromagnetic surface 10. Thus magnet assembly 22 can be pulled away from surface 10 by applying force to retracting device 40.

The force exerted by springs 28 reduces the force required to pull clamp 20 off of surface 10 and therefore reduces the required flux by some amount thus requiring a lesser coil current for un-clamping than for clamping. The amount of reduction depends on the stiffness of springs 28. In FIG. 5-C, clamp 20 is shown in a retracted position having been pulled off by an actuator (not shown) applying an actuation force F" in a direction shown by arrow 64. Magnet assembly 22 and retracting device 40 remain connected while the force is broken between magnet assembly 22 and ferromagnetic surface 10.

It should be apparent to a person skilled in the art that many variations in the process may be readily envisaged. In one specific variation of the above clamping and un-clamping schemes a current is applied earlier in FIG. 4-A thus speeding up the placing process. Similarly, a current can be applied prior to bringing retracting device core 42 into contact with magnet assembly 22. Many other variations are possible without departing from the scope of the invention.

The current source for energizing coils in retracting device 40 may comprise one or more suitable electrical power supplies. Additional circuitry may be provided to switch the current on and off as well as to provide for reversal of current flow. The switching and reversal functions may be provided by relays or semiconductor devices. In as much as such systems are well known in the art the details will not be further discussed herein.

Clamp 20 may comprise a single bar clamp with a plurality of magnets spanning the width of a drum surface. In the alternative, the bar could be segmented into a number of smaller clamps. A full bar clamp may not be optimal for clamping plates of different widths, since when clamping a narrow plate only part of the clamp will be over the plate surface. Segmenting the clamp allows each clamp to locally adapt to the plate underneath and also reduces risk of damage should a single clamp fly-off as opposed to an entire bar flying off.

In another alternative embodiment, the electromagnetic retracting device 40 described above is replaced by a permanent magnet retracting device. In such a device, a permanent magnet provides the opposing magnetic flux. In such a device, it is necessary to provide a means for changing the magnetic flux direction. This may be accomplished by either providing a pair of permanent magnets on an actuator disposed to have opposite polarizations or by rotating a single magnet.

In another embodiment, the clamp shown in FIG. 3 is constructed without the slidable magnet assembly 22 and springs 28 i.e. with magnet assembly 22 securely attached to clamp frame 21. As stated earlier the advantage of using a slidable magnet is that different thickness media may be clamped without compromised force since pole pieces 26 always contact ferromagnetic surface 10. However, if the thickness of media is substantially the same for all media to be loaded, a non-slidable magnet may be disposed to always contact the imaging bed surface and hence provide the benefits of the invention. In this embodiment, the retracting device still functions in essentially the same manner, opposing or reinforcing the flux of the permanent magnet in clamping and un-clamping operations.

Figure 6:
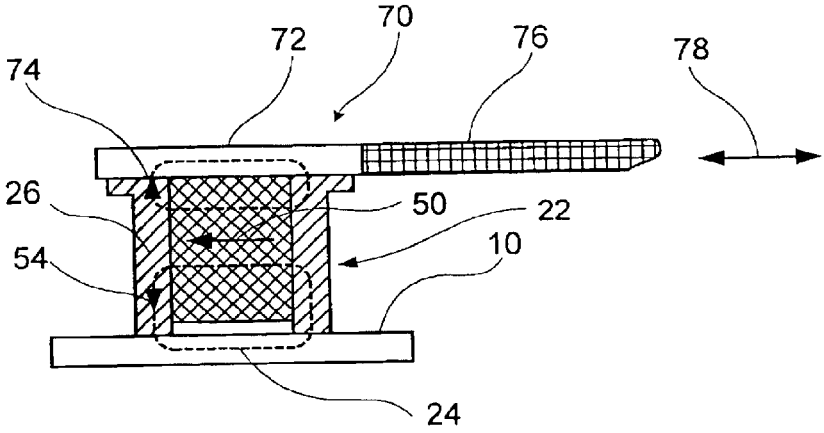
FIG. 6 is a sectional view of a magnet assembly showing a shorting bar in place for retracting the magnet from a ferromagnetic surface.

In another embodiment, the retracting device 40 shown in FIG. 3 is replaced by a shorting bar 70 as shown in FIG. 6. A ferro-magnetic material 72 such as steel provides a magnetic circuit for flux to flow in the direction of arrow 74. The diversion of flux to this circuit weakens the force between surface 10 and magnet 22. By making shorting bar 70 from areas of ferromagnetic material 72 and non-ferromagnetic material 76 and making the bar slidable in the direction of arrow 78 the shorting may be activated and deactivated by actuation in the direction of arrow 78.

Figure 7:
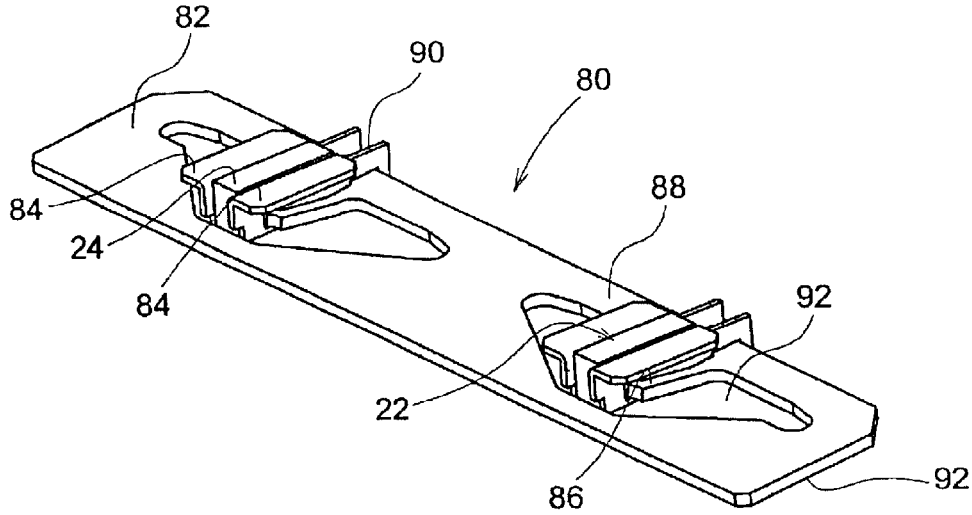
FIG. 7 is an isometric view of an alternative embodiment of the clamp according to the present invention.

In another embodiment shown in FIG. 7 a clamp 80 comprises a frame 82 fabricated from a suitable material, such as sheet metal. Frame 82 locates a pair of magnets 22, each magnet having a permanent magnetic material 24 flanked by a pair of pole pieces 84. Pole pieces 84 are elongated to form a pivot at 90 and to retain the magnet assembly 22 on frame 82. Frame 82 has cut out sections 92 that also serve to form a compliant web-hinge section 88. The combination of web-hinge section 88 and protruding tab 86 serve as a spring for biasing magnet 22 away from the underside of clamp 80. In this embodiment, magnet 22 does not slide in the frame 82, but rather moves relative to an underlying surface via web-hinges 88. The operation of clamp 80 is otherwise similar to that shown in FIGS. 5-A to 5-D and FIG. 6 except that magnet 22 is pivoted and transcribes an arc in moving from a position biased away from the imaging bed to a position in contact with the imaging bed.

The pull-off force necessary to remove the magnets from surface 10 may be reduced by applying a force preferentially to one end of the magnet so that the magnet is pivoted out of attachment with the surface thus weakening the attractive forces along the edge. This reduces the pull-off force required. In an alternative embodiment, shown in FIG. 8-A and in enlarged detail in FIG. 8-B, a clamp 100 has a lever 102 for lifting the edge of magnet 22. Lever 102 has a pivot 104 and the application of a force to pad 106 on lever 102 results in a force being preferentially applied to a point 108 on one side of magnet 22. The actuation to lever 102 at pad 106 may be provided by an actuation bar (not shown).

Various other embodiments of the invention which combine:

- a magnet assembly 22 which can be magnetically affixed to surface 10,
- a media hold down member (such as edge 21A) which is biased toward surface 10 when the magnet assembly is affixed to surface 10 and can thereby accommodate media 11 of different thicknesses are provided by this invention. In some embodiments the magnet assembly and media hold down member are connected so that, with the media hold down member in contact with media 11 or surface 10, the magnet assembly can be supported in a retracted position wherein it is not fully magnetically engaged with surface 10 and then selectively displaced into an engaged position wherein the magnet assembly is more strongly magnetically engaged with surface 10.

Figure 9A:
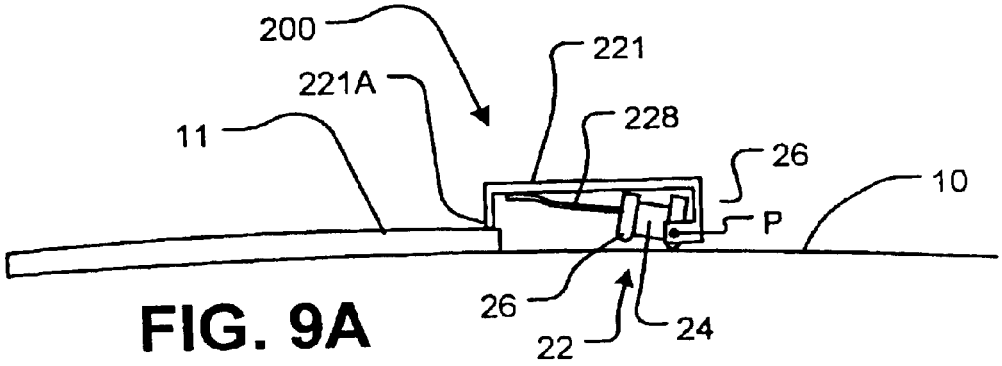
FIGS. 9A and 9B are schematic cross sections through a clamp according to an alternative embodiment of the invention in with a magnet assembly in retracted and engaged positions respectively.
Figure 9B:
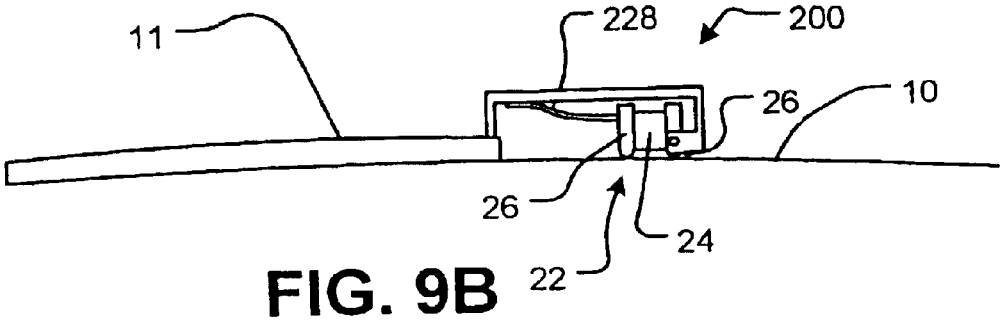

FIGS. 9A and 9B illustrate the principle of operation of a clamp 200 according to one such alternative embodiment of the invention. Clamp 200 has a magnet assembly 22 comprising magnet 24 and poles 26 which is pivotally attached to a hold down bar 221. An edge of hold down bar 221 bears against media 11. A spring 228 biases magnet assembly 22 toward the tilted "retracted" position shown in FIG. 9A.

Figure 10A:
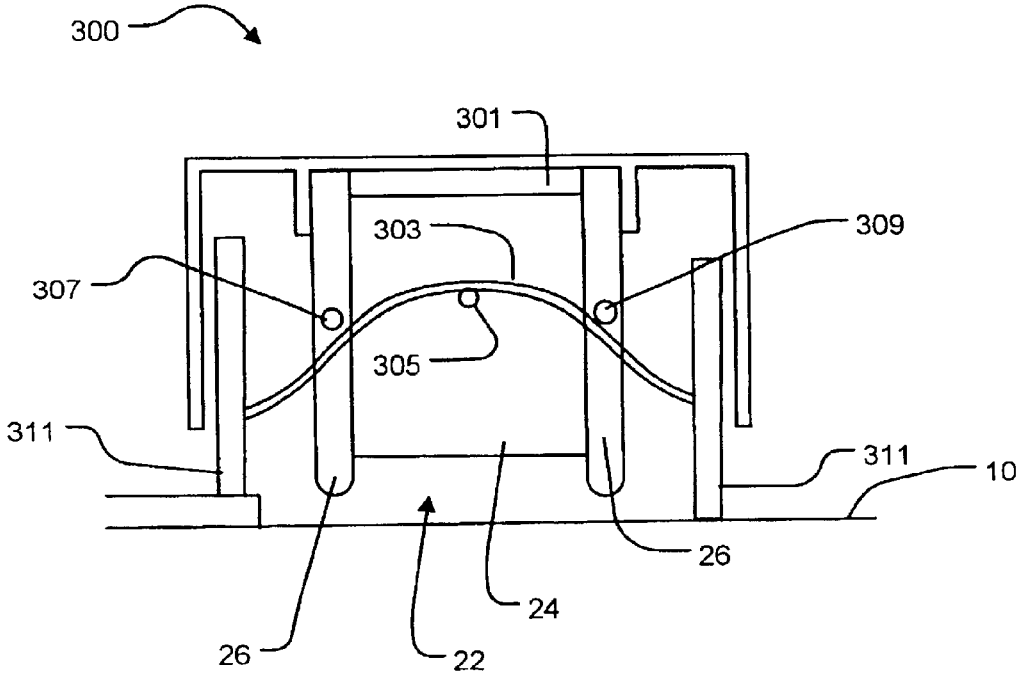
FIGS. 10A and 10B are schematic cross sections through a clamp according to an alternative embodiment of the invention in with a magnet assembly in retracted and engaged positions respectively; and, FIG. 11 illustrates a magnet assembly having pole pieces curved to match a curvature of a drum.
Figure 10B:
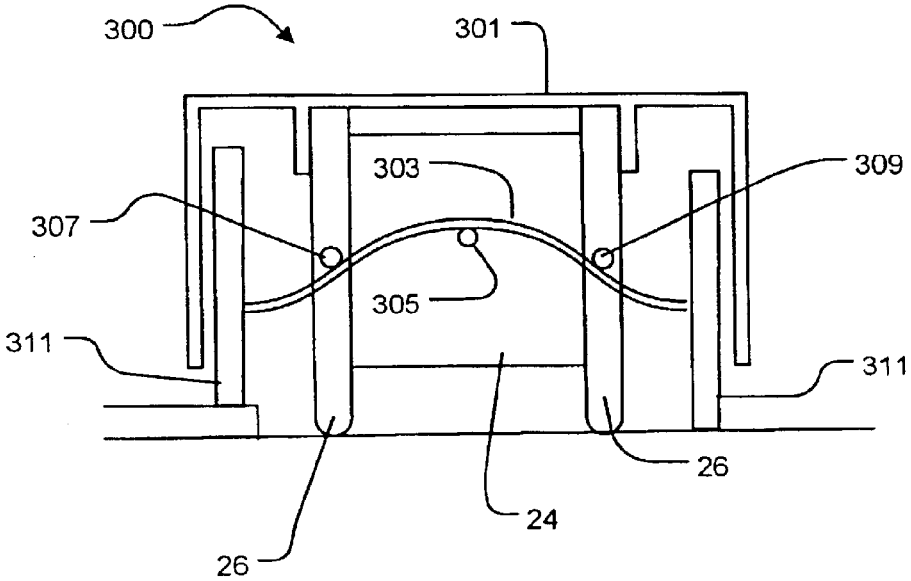

FIGS. 10A and 10B illustrate the principle of operation of a clamp 300 according to a further embodiment of the invention. In clamp 300, media hold down bars 311 are biased away from frame 301 (i.e. toward surface 10 by springs 303 which are bent around pins 305, 307 and 309. The edges of media hold down bars 311 constitute media engaging portions. In this embodiment, magnet assembly 22 comprising pole pieces 26 and permanent magnet 24 do not move relative to frame 301 in use. In FIG. 10A, magnet assembly 22 and frame 301 are in a retracted position. In FIG. 10B, magnet assembly 22 and frame 301 are in an extended position.

Example 1

A clamp and retracting device similar to that shown in FIG. 4 was constructed. A pair of Neodymium Iron Boron magnets having an energy product of approximately 50 MGOe were supplied by Magnetic Component Engineering, Inc. of Torrence, Calif. The pole pieces were made of mild steel and at contact with the ferromagnetic surface; the attractive force provided was approximately 330 Newtons per magnet. The springs were chosen to have a force of approximately 200 Newtons per magnet leaving a holding force of approximately 130 Newtons per magnet. The clamps were used to secure a 0.02 inch thick aluminum plate to a drum of diameter approximately 17 inches (432 mm). Under these conditions, the drum was run up to angular speeds in excess of 520 rpm without clamp fly-off or slippage of the plate under the clamp.

The retracting device coils were each wound with approximately 1250 turns. The current for clamping was approximately 0.4 Amperes while that for unlocking was approximately 0.2 Amperes, in the opposite direction. Pairs of retracting devices were connected in series and 10 such clamp/retracting devices were constructed and connected in parallel. The supply used was a 24 Volt 3 Amp conventional power supply and relays were used to interrupt and change direction of the current. The clamp was tested to 2.8 million clamping and un-clamping cycles without any significant deterioration.

Example 2

A clamping system for an imaging system was constructed. The system comprised 6 clamps of general dimension 190 mm×44 mm by 10 mm. Each clamp had 2 magnets slidably located in a clamp frame and retained by a leaf spring suspension. The force between each magnet and the drum was 240 N providing a total attachment force of 480 N. Under these conditions the clamp flyoff limit was established at a drum rotational speed of 1100 rpm.

The springs were arranged to apply a force of 116 N for a total spring force of 232 N applied to the media to clamp it to the drum. The media flyoff limit was found to be 730 rpm under these conditions.

Figure 11:
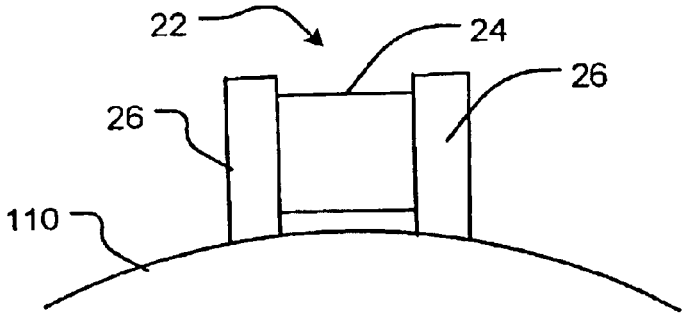

In the various depicted embodiments, permanent magnets 24 have been represented in the illustrations as rectangular-shaped members for sake of convenience. As will be clear to a person skilled in the art, permanent magnets 24 may have any of a wide variety of different shapes without departing from the scope of the invention. Magnets are commonly available in annular ring or cylindrical disk form with a variety of polling directions and a variety of pole piece configurations. The pole pieces of magnet assemblies 22 may be shaped to match a configuration of surface 10. For example, as shown in FIG. 11, where surface 10 is a surface 110 of a drum having a radius of curvature, the pole pieces 26 of magnet assemblies 22 may be curved to match the radius of curvature of the drum. In FIG. 11 the curvature of surface 110 is greatly exaggerated for purposed of illustration.

As will be apparent to those skilled in the art in the light of the foregoing disclosure, many alterations and modifications are possible in the practice of this invention without departing from the spirit or scope thereof. For example, The bias mechanism may comprise springs of configurations other than shown above. Embodiments of the invention may include torsion springs, leaf springs, coil springs, extension springs, compression springs, elastic members, or the like coupled in any suitable manner between the media-engaging portion of a clamp and one or more magnet assemblies to bias the media-engaging portion of a clamp toward a surface of an imaging bed. Any such bias mechanism and any reasonable equivalents thereof may be termed a bias means.

Accordingly, the scope of the invention is to be construed in accordance with the substance defined by the following claims.

What is claimed is:

1. A magnetic clamp for securing a media to an imaging bed, the clamp comprising:

a clamp frame having a media-engaging portion capable of bearing against the media;

at least one magnet located in the clamp frame wherein, when the media-engaging portion of the clamp frame is bearing against the media the magnet is moveable between a first position wherein the magnet is spaced apart from the imaging bed and a second position wherein the magnet engages the imaging bed; and, a bias mechanism connected to bias the magnet toward the first position.

2. A magnetic claim according to claim 1 wherein the bias mechanism comprises a spring connected between the clamp frame and the magnet.

3. A magnetic clamp according to claim 2, wherein the spring comprises a plurality of leaf springs attached to the clamp frame.

4. A magnetic clamp according to claim 2, wherein the spring is integral with the clamp frame.

5. A magnetic clamp according to claim 1, wherein the magnet comprises a permanent magnetic core and at least one pole piece located adjacent to the magnetic core, such that when the magnet is in the second position the pole piece engages the imaging bed while the magnetic core is spaced apart therefrom.

6. A magnetic clamp according to claim 5, wherein the imaging bed comprises a surface of a cylindrical drum and a portion of the pole piece that engages the drum is shaped to have a radius substantially the same as a radius of the cylindrical drum.

7. A magnetic clamp according to claim 1 wherein the clamp frame has an elongate channel configuration.

8. A magnetic clamp comprising a plurality of clamp sections, each of the clamp sections constructed according to claim 7.

9. A magnetic clamp according to claim 1, comprising an actuator for displacing the magnet between the first and second positions.

10. A magnetic clamp according to claim 9, wherein the actuator comprises a magnet is adapted to engage the magnet and apply a retracting force to the magnet preferentially along one side thereof.

11. A magnetic clamp according to claim 9, comprising a lever pivotally attached to the clamp frame and having a first end and a second end, the first end disposed to engage the magnet such that when a force is applied to the second end one side of the magnet is levered out of engagement with the imaging bed.

12. A magnetic clamp according to claim 9, wherein the actuator comprises an auxiliary permanent magnet for establishing a magnetic flux in opposition to the flux established by the magnet in the clamp frame, the auxiliary magnet aligned with the magnet in the clamp frame.

13. A magnetic clamp according to claim 9, wherein the magnet comprises a permanent magnetic core with a pair of pole pieces located adjacent to the magnetic core and the actuator comprises a shorting bar aligned with the pole pieces, the shorting bar for providing an alternate magnetic circuit for the magnetic flux established by the magnet.

14. A magnetic clamp according to claim 9, wherein the actuator comprises an electromagnet for establishing an opposing magnetic flux for temporarily reducing the clamping force during a clamping or retracting operation.

15. A magnetic clamp according to claim 1 wherein the imaging bed is fabricated from a non-ferromagnetic material and at least one ferromagnetic insert is provided for clamping the magnet to the imaging bed.

16. A magnetic clamp according to claim 1, further comprising means for temporarily reducing the attractive force between the magnet and the imaging bed during a clamping or retracting operation.

17. A magnetic clamp according to claim 1, wherein the magnet is slidably received in an aperture in the clamp frame.

18. A magnetic clamp for securing a media to an imaging bed, the clamp comprising:

an elongated media hold down member;

a magnet movably coupled to the media hold down member; and, a bias mechanism operative to exert a bias force to bias the media hold down member toward an imaging bed when the magnet is engaged with the imaging bed.

19. A magnetic clamp according to claim 18 wherein, with the media hold down member in contact with the imaging bed the clamp has retracted and engaged configurations such that when the clamp is in the retracted configuration the bias force is sufficient to overcome a force of magnetic attraction between the magnet and the imaging bed and when the clamp is in an engaged configuration the bias force is insufficient to overcome a force of magnetic attraction between the magnet and the imaging bed.

20. A magnetic claim according to claim 19 where the bias mechanism comprises a spring.

21. A magnetic clamp for securing a media to an imaging bed, the clamp comprising:

a magnet assembly generating a magnetic attraction to an imaging bed;

a member having a media-engaging portion on a first side of the magnet assembly;

an imaging-bed-contacting surface on a second side of the magnet assembly opposed to the first side and, bias means for biasing the magnet assembly away from the imaging bed when the media-engaging portion is in contact with a media on the imaging bed and the imaging-bed-contacting surface is on the imaging bed.

22. A magnetic clamp according to claim 21 wherein, when the media-engaging portion is in contact with a media on the imaging bed and the imaging-bed-contacting surface is on the imaging bed the clamp has retracted and engaged configurations such that when the clamp is in the retracted configuration the bias means exerts a bias force sufficient to overcome a force of magnetic attraction between the magnet and the imaging bed and when the clamp is in an engaged configuration the bias force is insufficient to overcome a force of magnetic attraction between the magnet and the imaging bed.

* * * * *

UNITED STATES PATENT AND TRADEMARK OFFICE

CERTIFICATE OF CORRECTION

PATENT NO. : 6,837,160 B2
DATED : January 4, 2005
INVENTOR(S) : Leppanen et al.

It is certified that error appears in the above-identified patent and that said Letters Patent is hereby corrected as shown below:

Title page,
Item [73], Assignee, where "Creo, Inc." should read -- Creo Inc. -- ;

Column 8,
Line 26, where "A magnetic claim" should read -- A magnetic clamp --; and Column 10,
Line 6, where "A magnetic claim" should read -- A magnetic clamp --.

Signed and Sealed this

Seventeenth Day of May, 2005

JON W. DUDAS
*Director of the United States Patent and Trademark Office*